US005989446A

United States Patent [19]

Hicks et al.

[11] Patent Number: 5,989,446

[45] Date of Patent: Nov. 23, 1999

[54] WATER ADDITIVE AND METHOD FOR FIRE PREVENTION AND FIRE EXTINGUISHING

[75] Inventors: Robert David Hicks, Summerfield; Jane Elisabeth Mills; Whei-Neen Hsu, both of Greensboro, all of N.C.

[73] Assignee: Stockhausen, Inc., Greensboro, N.C.

[21] Appl. No.: 09/076,309

[22] Filed: May 12, 1998

Related U.S. Application Data

[63] Continuation of application No. 08/557,862, Nov. 14, 1995, abandoned.

[51] Int. Cl.[6] ..... A62D 1/00; A62C 5/033; A62C 2/08

[52] U.S. Cl. ..... 252/8.05; 252/2; 252/601; 252/607; 252/610; 252/611; 252/3; 169/45; 169/46; 169/47; 106/18.11

[58] Field of Search ..... 252/2, 8.05, 601, 252/3, 607, 610, 611; 169/45, 46, 47, DIG. 2, 5; 106/18.11

[56] References Cited

U.S. PATENT DOCUMENTS

| | | | |
|---|---|---|---|
| 2,982,749 | 5/1961 | Friedrich | 526/207 |
| 3,758,641 | 9/1973 | Zweigle | 252/2 |
| 4,070,321 | 1/1978 | Goretta et al. | 524/801 |
| 4,078,133 | 3/1978 | Ozima | 526/80 |
| 4,978,460 | 12/1990 | Von Blücher et al. | 252/2 |
| 5,087,513 | 2/1992 | Kim | 428/283 |
| 5,190,110 | 3/1993 | Von Blücher et al. | 169/46 |
| 5,264,251 | 11/1993 | Geursen et al. | 427/389.9 |
| 5,297,847 | 3/1994 | Clark | 297/217 |
| 5,397,626 | 3/1995 | Berg et al. | 428/283 |
| 5,849,210 | 12/1998 | Pascente et al. | 252/3 |

*Primary Examiner*—Joseph D. Anthony
*Attorney, Agent, or Firm*—Jenkins & Wilson, P.A.

[57] ABSTRACT

In the prevention of the spread of fires and for directly fighting fires, a cross-linked, water-swellable additive polymer in water/oil emulsion produced by an inverse phase polymerization reaction to be added to the firefighting water is disclosed. The additive has the properties of absorbing large quantities of water, high viscosity for adherence to vertical and horizontal surfaces, and retention of sufficient fluidity to be educted in standard firefighting equipment. The method of adding this additive to the firefighting water by eduction or by a batch addition to the water source is also disclosed.

12 Claims, 2 Drawing Sheets

WATER ADDITIVE AND METHOD FOR FIRE PREVENTION AND FIRE EXTINGUISHING

RELATED APPLICATIONS

This application is a Continuation of co-pending application Ser. No. 08/557,862 filed on Nov. 14, 1995 now abandoned.

BACKGROUND OF THE INVENTION

The present invention relates to an additive to water for fire prevention and fire extinguishing, and further relates to the use of a cross-linked polymer with thickening properties as the primary component of the additive.

Water is the most commonly used substance to extinguish fires and to prevent the spread thereof to surrounding structures. Water has several effects on a fire, such as heat removal and oxygen deprivation. When structures adjacent to a fire are soaked with water, the fire must provide enough heat to evaporate the water before the structure can reach its combustion or ignition temperature. A significant disadvantage to the use of water to soak adjacent structures is that the water that does not soak into the structure tends to run off or fall unused upon the ground, thus wasting the water. Another disadvantage is that the water that does soak into the structure provides only a very limited protection against the fire because the structure may only absorb a limited amount of water, and that water is quickly evaporated. Also, significant manpower must be expended to resoak those structures from which the water is evaporated to provide continuing fire protection.

A further disadvantage to using water in fighting fires is that a significant amount of the water does not directly fight the fire because of the aforementioned run-off. Another disadvantage to using water in fighting fires is that water sprayed directly on the fire evaporates at an upper level of the fire, with the result that significantly less water than is applied is able to penetrate sufficiently to extinguish the base of the fire.

To address the above disadvantages with water, U.S. Pat. No. 5,190,110, issued to von Blucher et al, uses absorbent polymers with particle sizes from 20 to 500 microns dispersed in a water miscible media to be incorporated into the water by stirring or pumping, such that the resultant viscosity does not exceed 100 mPa•s. This system contains discrete gel particles that absorb water, without being soluble in water, and are entrained in the water for application directly to a fire. The '110 patent teaches directly away from using any materials that result in a higher viscosity than 100 mPa•s. The usual method of applying the additive in the '110 patent is to pre-mix the solid granule particles with the water source. An alternative method that is disclosed is to add the solid granule particles directly in advance of the nozzle while they are in the non-swollen condition. This alternative does not provide sufficient time for the particles to swell, and the viscosity is not increased sufficiently to allow the particles to adhere to surfaces. This is akin to just throwing the solid polymer particles on the fire in the hopes that they will swell after application.

Likewise, U.S. Pat. No. 4,978,460, issued to von Blucher et al, addresses the problem of using solely water to extinguish fires. The solid polymer particles of the '460 patent are encased by a water-soluble release agent to avoid any agglutination of the particles. The time that it takes for these solid granular particles to expand from the absorption of water ranges from ten seconds to several minutes. When fighting a fire with typical hose lengths, ten seconds is longer than practical for the water to be retained in a fire hose. Additionally, in order to achieve the desired water absorption, it was necessary to introduce 200 grams of the product of the '460 patent into each liter of water. At this rate, approximately 835 pounds of the product would be required for a typical 500 gallon pumper.

U.S. Pat. No. 3,758,641, issued to Zweigle, also discusses the use of solid granular polymer particles with high water absorption in firefighting applications. Use of these particles is best accomplished with special, additional firefighting equipment.

The state of use of absorbent polymers in fighting fires remains that due to the solid, granular nature of the particles, it is difficult, if not impossible, to use these polymers in many firefighting applications. For example, if a natural source of water, such as a creek or a river, is to be used as the water source, it is impossible to pre-mix the polymer and batch add it to the water source, as necessary in traditional applications, in order to draw it off to use to combat fires. By pouring the additive-into a stream or river, most of the additive will simply flow past the point of suction of the water for use in combating fires. Likewise, because of the particulate nature of the state-of-the-art firefighting, water-absorbent polymer, eduction of such polymer into the standard firefighting hose with standard equipment is nearly impossible. The solid nature of the polymers promote agglutination of the particles and subsequent blockage of the flow of the water. Alternatively, it is also sometimes necessary to provide "pumps and spray nozzles adapted for handling for such materials" in the use of these solid granular particles (see, for example, Zweigle '641). Additionally, the smallest particle size disclosed by the current water-absorbent polymer art for use in firefighting is no less than 20 microns.

Thus, it becomes desirable to develop a water-absorbent polymer that is not limited in application, as are the above polymers, by a solid, granular state. Such a water-absorbent polymer for use as a yarn coating is disclosed in U.S. Pat. No. 5,264,251, issued to Geursen et al.

The polymer provided in Geursen provides substantial water absorption and can be processed in stable water-in-oil emulsions. Such an emulsion allows this absorbent polymer material to be applied to a yarn. It is important for the polymer formed in such a water-in-oil emulsion in the Geursen patent to retain a relatively low viscosity. This is critical to the application of the polymer to the yarn.

Thus, it would be desirable to provide a water-absorbent polymer that will quickly swell in the presence of water for application in firefighting situations. Such a composition would be mixable with the water source and desirably be eductable into a fire hose using standard firefighting equipment to allow its use in a very wide variety of firefighting situations, and also have sufficient viscosity to enable it to adhere to vertical and horizontal surfaces.

SUMMARY OF THE INVENTION

It is an object of the present invention to provide a water additive to be used in fire prevention and fire extinguishing that has the characteristics of a highly water-absorbent polymer that is easily mixed with the water supply for fighting fires and, when combined with water, results in a water-additive mixture with sufficiently high viscosity that the mixture readily adheres to vertical and horizontal surfaces. It is a further object of the present invention to provide an additive to water to be used in fire prevention and fire extinguishing which has a very short swell time to absorb the water, and which is easily educted into a fire hose through the use of standard firefighting equipment.

The present invention is a water additive and method to be used in fire prevention and fire extinguishing. The additive is comprised of a cross-linked, water-swellable polymer in a water/oil emulsion that is produced by an inverse phase polymerization reaction. Preferably, the polymer is a co-polymer of acrylamide and acrylic acid derivatives and, more preferably, the polymer is a terpolymer of a salt of acrylate, acrylamide, and a salt of 2-acrylamido-2-methylpropanesulfonic acid (AMPS). The particles resulting from this polymerization are generally less than about one micron in size. The particles are dispersed in an oil emulsion wherein the polymer particles are contained within discrete water "droplets" within the oil. With the help of an emulsifier, the water "droplets" are dispersed relatively evenly throughout the water/oil emulsion. This allows the additive to be introduced to the water supply in a liquid form, such that it can be easily educted with standard firefighting equipment.

The nature of this additive is such that it is a thickener for the water, and combines this thickening property with a very high water absorption capacity. Thus, the water-additive mixture that is sprayed from the end of a fire hose has a relatively high viscosity and adheres readily to both vertical and horizontal surfaces. This adherence allows the water-additive mixture to prevent the fire from damaging the structure to which it adheres for relatively long period of time, minimizing the manpower needed to resoak the structure.

Because the quantity of water absorbed by the additive evaporates less quickly than that provided by pure water, use of this additive will also provide more water to prevent and/or extinguish fires.

Using this water-additive mixture to coat a structure that is near a fire allows the additive to provide a protective coating to the structure. Thus, the fire will not spread as rapidly because it must overcome the effects of the significant quantity of water present in the molecules of the additive that adhere to the structure.

The method of adding this additive to the firefighting water is via eduction or batch addition to the source water. The nature and properties of the additive enable eduction through standard firefighting equipment.

DESCRIPTION OF THE PREFERRED EMBODIMENT

The present invention is a water additive and system to be used in fire prevention and fire extinguishing. In the preferred embodiment, the additive is a water-in-oil cross-linked polymer produced by inverse phase polymerization.

Figure 1:
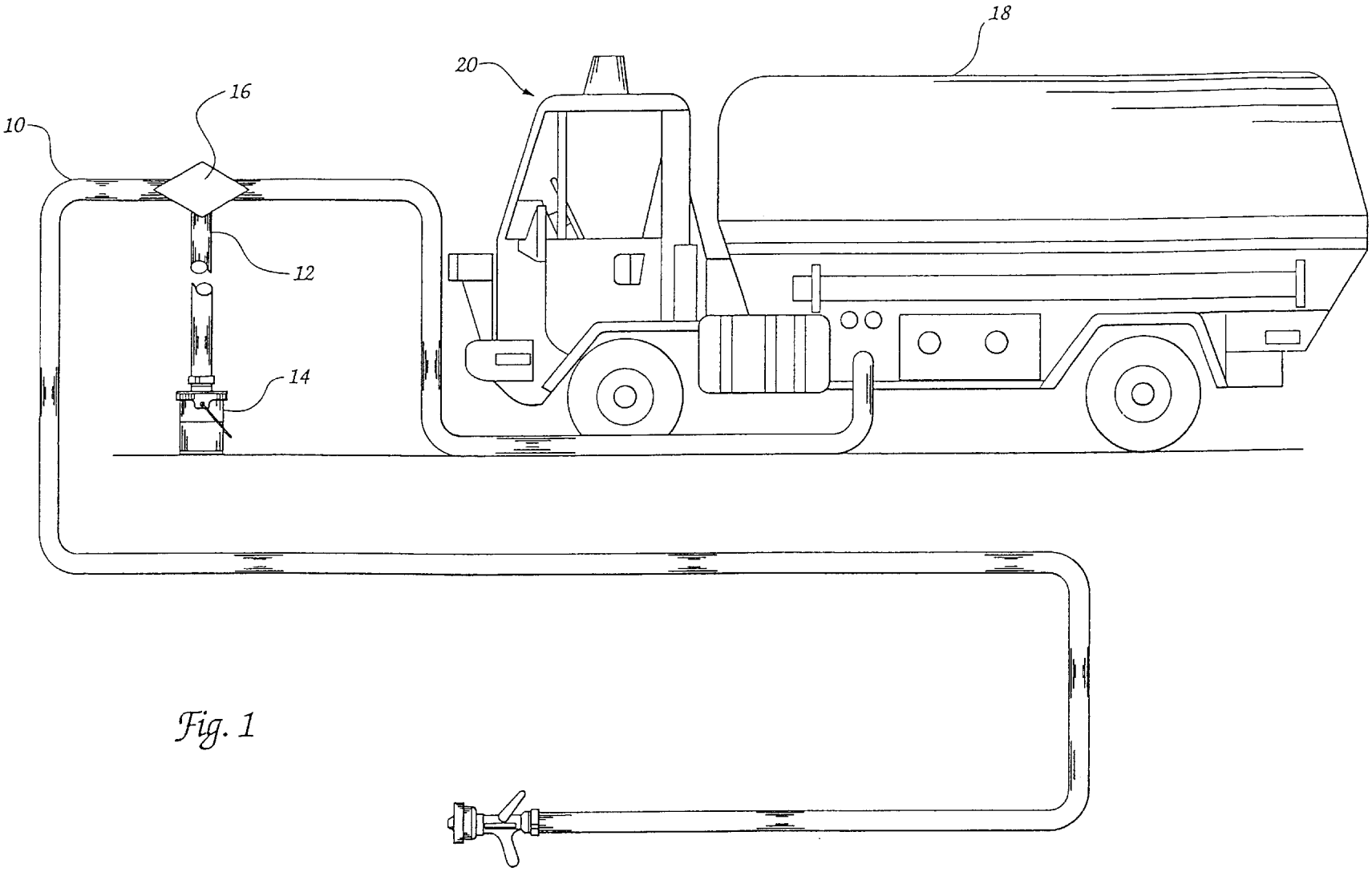
FIG. 1 is an illustration of typical equipment used in the preferred embodiment of the method of the present invention using the water additive of the preferred embodiment of the present invention.

As shown in FIG. 1, the additive is educted into a fire hose 10 in a manner similar to that currently used to educt firefighting foams, such as AFFF (aqueous film-forming foam). A trailing hose 12 is placed in a bucket 14 of additive. The flow of water through the fire hose 10 creates a negative pressure at an eductor nozzle, schematically represented by numeral 16, which then draws the additive from the bucket 14 into the flow of water through the fire hose 10. The eductor nozzle 16 has an internal valve by which the flow of additive may be controlled. This additive may be used with existing standard firefighting equipment and does not require purchase of new equipment, as does the use of the solid, powdered additives that are traditionally available. Because the present additive is a flowable emulsion, there is no need to add a carrying or release agent to enable it to be educted or mixed, as is necessary with the traditional powdered additives, such as that represented by the U.S. Pat. No. 4,978,460, issued to von Blucher et al. As an alternate method, the additive may be batch added to the water tank 18 on a fire truck 20. Once again, because the additive is emulsified, there is no need for the extensive agitation disclosed in the prior art or for addition of a separate carrying or release agent to avoid clumping, as is necessary with the solid additives that are presently used. Some mixing is still required in such a batch addition.

The additive combines the properties of a superabsorbent polymer, in that it can absorb significant quantities of water in relation to its size and weight, and a thickener, in that the resulting water-additive mixture has a relatively high viscosity. In the non-mixed state, the additive is contained within the droplets of water dispersed in oil in a water/oil emulsion. With the help of an emulsifier, the water droplets are relatively evenly distributed throughout the emulsion. When the additive is introduced to a significant quantity of firefighting water, such as through eduction into a fire hose or batch addition into a water tank, the water droplets mix with the firefighting water and the tiny (generally <1 $\mu$m in size) polymer particles within the water droplets are now exposed to a large volume of water and absorb significant quantities of the water.

The additive of the present invention is produced by inverse phase polymerization, as are thickeners. Thus, the resulting additive is an emulsion polymer in a liquid form, unlike traditional superabsorbent polymers which are in powdered, granular form. Production of the additive through inverse phase polymerization also results in a particle size that is always less than about 2 microns, and generally less than about one micron. The size of the particles in typical superabsorbent polymers used in firefighting is almost always (99%) greater than 20 microns. Swollen emulsion polymers also react differently in the presence of water than do typical superabsorbent polymer particles. Typical particles retain their individual particle integrity when swollen, and may tend to clump, whereas the swollen emulsion thickener particles form a homogeneous, highly viscous fluid. Because of the nature of the emulsion polymer, the resulting water-additive mixture has a short (less than about three seconds) swell time, relatively high viscosity, allowing the mixture to easily adhere to both vertical and horizontal surfaces, and sufficient fluidity to allow the additive to be easily educted through standard firefighting equipment.

Figure 2:
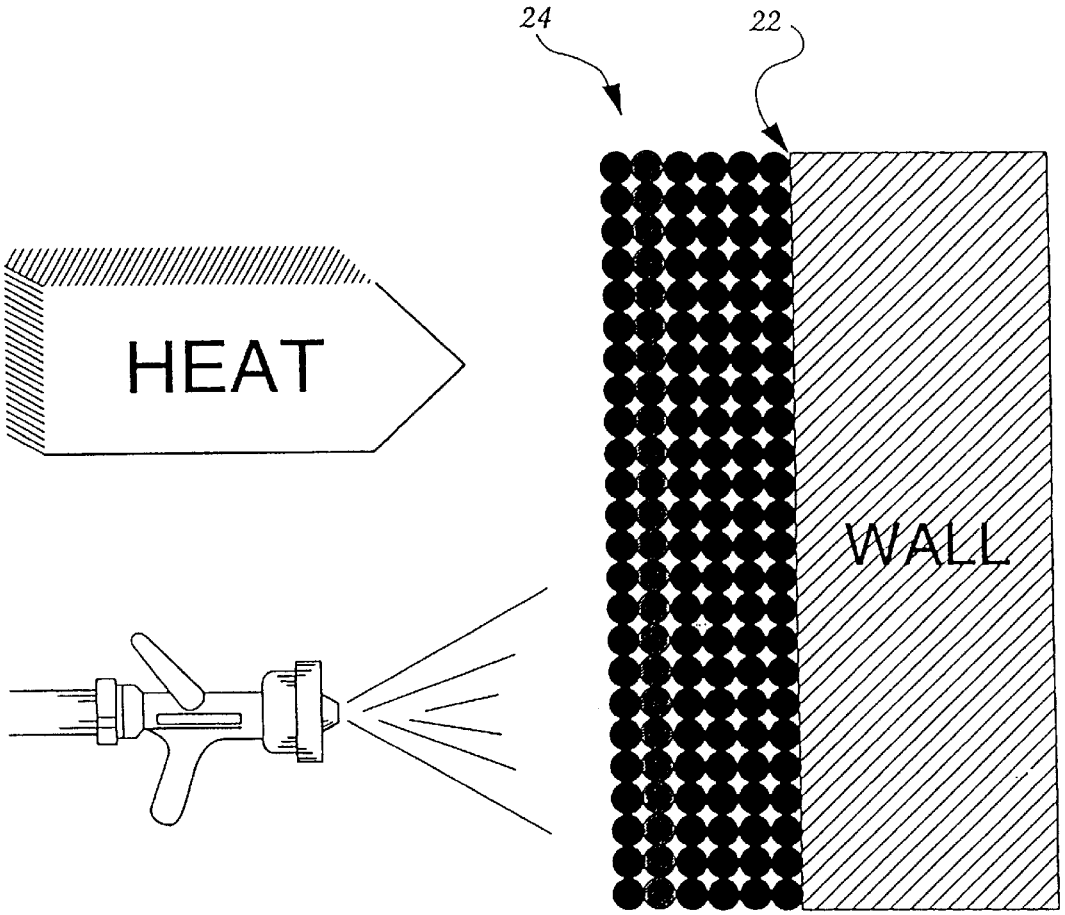
FIG. 2 is a schematic representation of the use of the preferred embodiment of the present invention.

When the water-additive mixture is sprayed onto a vertical or horizontal surface, the mixture adheres to the surface, providing extended fire protection for structures located near a fire. As illustrated in FIG. 2, when the mixture is sprayed onto a surface 22, millions of additive molecules 24 are stacked on top of each other. This is similar to how AFFF and other foams are used, but the molecules 24 of the present invention are laden with water and the traditional foam bubbles are filled with air. This water fill dramatically enhances the thermal protection qualities of the present invention.

When the fire approaches the surface, the outer molecules 24 that are closest to the fire absorb the heat until the point of water evaporation is reached. This protects the molecules 24 that are closer to the wall until the water of the outer molecules 24 evaporate. Then the next layer of molecules 24 absorb heat until the point of water evaporation is reached, shielding the remaining inner layers of molecules. This process continues until the water of the innermost layer of molecules 24 is evaporated. This process absorbs heat significantly more effectively than does the use of conventional foams that use air instead of water to absorb the heat. Water is able to absorb more heat than that absorbed by air bubbles.

As an additional benefit, by the time that the fire has evaporated the water from the molecule layers down to the protected surface, the additive coating the surface above the point of fire penetration will slide down to partially re-coat and continue to protect the area penetrated by the fire. This also minimizes the manpower and material resources currently necessary to periodically resoak the surface. Obviously, at some point the fire will evaporate substantially all of the water from the additive if the fire continues to burn. But by retarding the advance of the fire and the damage done by the fire, and by using the additive to directly fight the fire, firefighters will be able to more effectively fight the slowed fire and the damage done by the fire will be significantly reduced from what the damage would be using conventional firefighting techniques and materials. This represents a substantial leap forward in firefighting technology.

When water is sprayed directly onto a fire, much of the water never effectively fights the fire, because the superheated air above the fire evaporates the water before the water can reach the flames. When the present additive is used, the same principles of heat absorption discussed above allow more water to reach the fire. Because the water-laden additive molecules have a greater surface area than a simple water molecule, the evaporation process is slowed. Thus, more water reaches the fire and the fire is doused with less water than when using simply water, or even when using conventional additives, such as fire fighting foams. Also, when simply applying water, a large proportion of the water that is applied directly to the fire and is not evaporated runs off or soaks into the ground and is thus wasted after its initial application. As an additional benefit, the water-additive mixture of the present invention also coats the ashes or the charred structure that was burning, instead of running off or soaking into the ground, and helps to prevent reflashing, because the waterladen molecules are able to absorb heat and the mixture, which is viscous, adheres to the surface and deprives the location of the oxygen needed for combustion, thus providing a smothering effect on the burned surface.

Because of these properties of the additive, the water-additive mixture is also suitable for use as an artificial fire break when fighting forest or brush fires. The mixture can be sprayed in advance of the fire and will coat the structure, such as bushes and trees, such that the fire will stop its advance when it reaches the treated area, allowing the firefighters to extinguish the flames without the fire advancing further. This causes significantly less damage than does the use of conventional means of fire breaks, such as using bulldozers or controlled burning to clear an area for a fire break.

The key to the success of this additive is the fact that it can absorb water in significant quantities relative to its own weight. These polymer particles contain 30–40% water by weight before they are introduced to the firefighting water. Once the additive particles have been added to the firefighting water and absorb this water to near their capacity (which takes about 3 seconds), they will carry more than 90% of the water (by weight) that is used to fight the fire.

The polymer is preferably a cross-linked, water-swellable polymer in a water/oil emulsion that is produced by an inverse phase polymerization reaction. The polymer may be a polymer of hydrophilic monomers, such as acrylamide, acrylic acid derivatives, maleic acid anhydride, itaconic acid, 2-hydroxyl ethyl acrylate, polyethylene glycol dimethacrylate, allyl methacrylate, tetraethyleneglycol dimethacrylate, triethyleneglycol dimethacrylate, diethylene glycol dimethacrylate, glycerol dimethacrylate, hydroxypropyl methacrylate, 2-hydroxyethyl methacrylate, 2-tert-butyl aminoethyl methacrylate, dimethylaminopropyl methacrylamide, 2-dimethylaminoethyl methacrylate, hydroxypropyl acrylate, trimethylolpropane trimethacrylate, 2-acrylamido-2-methylpropanesulfonic acid derivatives, and other hydrophilic monomers. Preferably, the polymer may be a co-polymer of acrylamide and acrylic acid derivatives and, more preferably, a terpolymer of a salt of acrylate, acrylamide, and a salt of 2-acrylamido-2-methylpropanesulfonic acid (AMPS), and, most preferably, the salts are sodium salts. Such inverse phase polymerization reaction technology is currently known in the art.

The degree of cross-linking of the polymer substantially affects the viscosity and adherence properties of the resultant polymer. A suitable cross-linking chemical for this application is trially methyl ammonia chloride. Modification of the use of this chemical results in a more or less viscous product. A viscosity of significantly greater than 100 mPa•s, and even in the range from 500 mPa•s to 50,000 mPa•s is easily obtainable and beneficially utilized for the additive of the present invention. This is in contrast with the state of the art as represented by U.S. Pat. No. 5,190,110, issued to von Blucher et al., which teaches that viscosities above 100 mPa•s are undesirable and unworkable in fighting fires. The higher viscosities supported by the present invention allow the additive to have better adherence to vertical surfaces, and still are sufficiently fluid such that the additive can be successfully educted through standard firefighting equipment.

The addition of an emulsifying agent to the additive in the emulsification process significantly improves the swell time (the time to absorb effective quantities of water). A suitable emulsifying agent for this application is a water-insoluble, oil-soluble surface active agent of the type disclosed in U.S. Pat. No. 4,786,681. A particularly suitable emulsifying agent is Hypermer 2296, marketed by Imperial Chemical Industries, London, England. Those skilled in the art will recognize that other emulsifying agents are also suitable.

Because the degree of hardness of the water, in other words the amount of cations in the water, affects the degree of swelling of the additive particles, a component is also introduced to counteract this effect. A suitable chemical for this countereffect in this application is AMPS or its derivatives. It will be obvious to one skilled in the art that the amount of AMPS included in the additive may be varied depending on the hardness of the water in the particular region of use. Also, the additive is effective without inclusion of a chemical to counteract the water hardness, particularly in those regions of the country that do not experience hard water.

Another factor that contributes greatly to the swell time is the size of the particles. The particle size of the present invention is generally less than one micron and 100% of the particles are less than about 2 microns. This is a significant improvement over typical superabsorbent polymer particles used in fire protection and prevention, the size of which is generally greater than 100 microns, and not disclosed to be less than 20 microns. The smaller particles of the present invention allow for a shorter swell time which, in turn, allows for the particles to complete the swell during the time the water-additive mixture is in the fire hose after the point of eduction. The additive of the present invention has a swell time of no more than about three seconds, whereas the swell time of the particles in the current state of the art have, at best, a swell time of about 10 seconds (see, e.g., von Blucher et al. '460), and often disclosed in terms of minutes or hours (see, e.g., U.S. Pat. No. 3,247,171, issued to Walker et al.), before the traditional firefighting additives have absorbed sufficient water to be suitable for use. These longer swell times are inadequate for use of the traditional additives in an eduction system without significant advance preparation and/or use of special equipment.

One particularly troublesome area of research and experimentation was determining the proper invertor(s) and ratios thereof to add in the polymerization process to ensure that the swell time of the particles was ≦3 seconds. The two invertors that were determined to work optimally are nonyl phenol, 4 moles EO, and nonyl phenol, 6 moles EO in a 1:4.3 ratio by weight.

Because of the short swell time and the water/oil emulsion state of the additive of the present invention, versus the dry powder state of the current art particles, the additive of the present invention is superbly situated to be used in a standard eduction system with a fire hose and a water source, such as a tanker truck or a fire hydrant. This eliminates the need for special equipment to practice the invention. It will be obvious to one with skill in the art that the present invention is also suitable for use by directly adding the additive to the tank in a tanker truck. To this end, only five gallons of additive is necessary to treat the standard 500 gallon tank on a fire tanker truck. This is less than 50 pounds per 500 gallons. This is a significant improvement over the state of the art, as illustrated by the von Blucher et al. '460 patent, wherein 200 grams of additive are required for every liter of water, which is equivalent to about 835 pounds for a typical 500 gallon tank. Thus, the present invention results in significantly less bulky material being required to be present at the scene to aid in combating a fire.

Several tests of the additive have been conducted to evaluate the firefighting and fire protection properties thereof.

TEST EXAMPLE 1

A 4 feet by 8 feet sheet of ⅜ inch plywood was coated to a thickness of ⅛ to ¼ inch with a 1.5% solution of the water-additive mixture. Following this application, the plywood was subjected to an open flame generated by a propane gas jet and the time to burn through was measured and compared with the time to burn through of an identical sheet of plywood which was not treated. The burn-through time for the treated plywood was 11 minutes, 7 seconds. The burn-through time for the untreated plywood was 3 minutes, 0 seconds.

TEST EXAMPLE 2

A 4 feet by 8 feet sheet of ⅜ inch plywood was coated with the water-additive mixture and subjected to a temperature of 2800 degrees. An identical untreated sheet of plywood was exposed to the same conditions. The untreated sheet was fully engulfed in flames in 45 seconds, and the wood was charred so badly that the surface was burned off, leaving it thinner. The treated sheet, with a coating of 2% solution of the additive, did not burn at all, except for a small area where the heat moved the coating. Even the supports behind the wall burned because of the heat, but not the plywood sheet.

Other tests have also been conducted that demonstrate the exceptional fire protection and firefighting properties of the present invention.

In application, the additive may be provided in five gallon buckets for use with a standard eduction system. The concentration of additive for the eduction is preferably between 0.01% and 10% (volume to volume), but concentrations of up to about 50% are acceptable. Once the concentration is significantly above 50%, the viscosity of the water-additive mixture becomes unwieldy. Likewise, for use in direct mixing into a tank, the additive is batch mixed in a concentration of preferably between about 0.01% and 10% (volume to volume), but concentrations of up to about 50% are acceptable. It is noted that additive concentrations of from about 1.0% to about 2.0% (volume to volume) provide suitable characteristics for firefighting, and thus greater concentrations are generally unnecessary. The use of lower concentrations also improves cost effectiveness.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for applying polymer particles made by an inverse phase polymerization reaction having a size of less than about 2 microns as a water-absorbent additive to a surface to combat fires, said method comprising adding the sad water-absorbent additive in the form of a water-in-oil emulsion to water in an amount sufficient to increase the viscosity of the resulting water-additive mixture to above 100 mPa•s, the said additive is present in sufficient quantity such that after absorption of water the i additive holds more than about 50% by weight of the total water, the water-additive mixture being directed onto the said surface.

2. The method of claim 1, further comprising the step of educting the additive into the water through standard firefighting eduction equipment.

3. The method of claim 1, further comprising the step of batch-adding the additive to the water prior to use of the water in firefighting.

4. The method of claim 1, wherein the swell time of the additive is no more than about three seconds.

5. The method of claim 1, wherein the addition of the additive to water results in a water-additive mixture with viscosity of from about 500 mPa•s to about 50,000 mPa•s.

6. The method of claim 1, wherein the additive comprises a polymer of at least one monomer selected from the group consisting of hydrophilic monomers.

7. The method of claim 6, wherein the polymer is a polymer of acrylamide and acrylic acid derivatives.

8. The method of claim 7, wherein the polymer is a polymer of at least one of a salt of acrylate and acrylamide.

9. The method of claim 7, wherein the polymer is a terpolymer of a salt of acrylate, acrylamide, and a salt of 2-acrylamido-2-methylpropanesulfonic acid.

10. The method of claim 1, wherein the additive is added to water in a concentration of from about 0.01% by volume to about 50% by volume.

11. The method of claim 10, wherein the additive is added to water in a concentration of from about 0.01% by volume to about 10% by volume.

12. The method of claim 11, wherein the additive is added to water in a concentration of from about 1% by volume to about 2% by volume.

* * * * *

UNITED STATES PATENT AND TRADEMARK OFFICE

CERTIFICATE OF CORRECTION

PATENT NO. : 5,989,446

DATED : November 23, 1999

INVENTOR(S) : Robert David Hicks, et al.

It is certified that error appears in the above-identified patent and that said Letters Patent is hereby corrected as shown below:

On title page, item [75] Inventors
replace ", both" with --; Robert A. Agne, all--.

Signed and Sealed this

Twenty-sixth Day of September, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO : 5,989,446

DATED : November 23, 1999

INVENTOR(S) : Robert David Hicks, et al.

It is certified that error appears in the above-identified patent and that said Letters Patent is hereby corrected as shown below:

In claim 1, at line 45 of column 8, replace "sad" with --said--,
and at line 49 of column 8, replace "i" with --said--.

Signed and Sealed this

Twenty-sixth Day of December, 2000

*Attest:*

Q. TODD DICKINSON

*Attesting Officer*

*Director of Patents and Trademarks*